United States Patent [19]

Warnars

[11] Patent Number: 4,752,247

[45] Date of Patent: Jun. 21, 1988

[54] ELECTRICAL CONNECTOR FABRICATED WITH UNITARY FRAME

[75] Inventor: Jacque Warnars, Roseville, Mich.

[73] Assignee: Altair, Inc., Mt. Clemens, Mich.

[21] Appl. No.: 755,283

[22] Filed: Jul. 15, 1985

[51] Int. Cl.[4] ..... H01R 13/506

[52] U.S. Cl. ..... 439/684; 439/688; 439/460; 439/891

[58] Field of Search ..... 339/191 R, 191 M, 191 A, 339/191 S, 192 R, 206 R, 206 P, 207 R, 208, 210 R, 210 M, 276 SF, 176 MF, 107, 277 R, 275 T, 278 T, 17 F, 278 L, 143 T

[56] References Cited

U.S. PATENT DOCUMENTS

| | | | |
|---|---|---|---|
| 2,073,880 | 3/1937 | Robinson | 339/191 R |
| 2,613,252 | 10/1952 | Heibel . | |
| 2,658,184 | 11/1953 | Greenbaum | 339/107 |
| 2,852,755 | 9/1958 | Martines | 339/275 T |
| 2,917,723 | 12/1959 | Gluck . | |
| 2,979,688 | 4/1961 | Clewes . | |
| 3,183,475 | 5/1965 | Meyer et al. . | |
| 3,225,323 | 12/1965 | Deakin . | |
| 3,273,105 | 9/1966 | Klassen | 339/191 A |
| 3,460,088 | 2/1967 | Arnao et al. . | |
| 3,668,475 | 6/1972 | Owens et al. | 339/194 R |
| 4,025,142 | 5/1977 | Haber et al. | 339/176 MF |
| 4,072,376 | 2/1978 | Shannon | 339/17 C |
| 4,248,491 | 2/1981 | Mouissie | 339/176 MF |
| 4,265,508 | 5/1981 | Chisholm | 339/276 SF |

*Primary Examiner*—Gil Weidenfeld
*Assistant Examiner*—Thomas M. Kline
*Attorney, Agent, or Firm*—Weingarten, Schurgin, Gagnebin & Hayes

[57] ABSTRACT

A connector adapted for connection to the terminal pins of an electrical or electronic device or circuit and which includes a planar contact assembly which is formed in a stamped integral planar frame retained within a two-piece housing with constituents of the housing operative to retain corresponding portions of the frame and wires connected thereto. The frame includes contact members and integral intermediate members which provide a unitary structure for ease of fabrication and handling. The unitary frame is installed in the housing as a unit and intermediate portions of the frame are later severed from the frame to provide individual contacts, each electrically connected to a respective wire of an associated cable.

4 Claims, 4 Drawing Sheets

ELECTRICAL CONNECTOR FABRICATED WITH UNITARY FRAME

FIELD OF THE INVENTION

This invention relates to electrical connectors and more particularly to a female connector employed with a multiwire electrical cable and adapted to be press fit into a plurality of terminal pins.

BACKGROUND OF THE INVENTION

Electrical connectors are often employed to interconnect the wires of a multiconductor cable to terminal pins of an electrical or electronic device or circuit. Such connectors often comprise an electrically insulative body having a plurality of electrical terminals each adapted to make contact with a respective terminal pin of an associated device or circuit when the connector body is inserted over the pins. The electrical contacts of the connector are usually formed by stamping or machining processes to provide a spring-type of contact such that electrical connection between a pin and connector contact is provided by spring action of the contact structure. In general, machined contacts are more costly to fabricate than stamped contacts, and for many purposes, stamped contacts of known construction are still too costly to be widely employed.

SUMMARY OF THE INVENTION

In accordance with this invention, a connector is provided for reliable electrical connection to associated terminal pins and which can be fabricated at relatively low cost by high speed production techniques. The novel connector is adapted to be employed with the terminal pins of small motors or any other electrical or electronic device or circuit. The connector includes a contact assembly which is formed in a stamped integral planar frame which includes contact members and integral intermediate members. The frame is retained within a two-piece housing having a base section and a cover section, with constituents of the housing operative to retain corresponding portions of the frame and wires connected thereto. The frames are preferably formed in repetitive manner from a continuous strip of metal, and individual frames are separated from the strip for incorporation into the associated housing. The individual frame is soldered or otherwise electrically and mechanically attached to the wires of a multiwire cable.

The frame and contiguous portion of the cable are installed as a unit in the base section of the housing, which includes receptacle portions for retaining each of the contact members of the frame as well as portions for retaining the contiguous portion of the cable and intermediate portions of the frame. The cover section of the housing is thereafter fitted over the base section and secured thereto such as by fastener pins provided in one or both sections of the housing. The cover section includes constituents cooperative with corresponding constituents of the base section for retention of the frame and contiguous cable portion. The housing includes aligned openings in which each contact member is disposed and by which the contacts are inserted over the terminal pins of an associated device or circuit. The housing also includes openings in which the intermediate portions of the frame are disposed, which portions are employed for maintaining the contacts as part of a unitary frame structure. These intermediate portions are severed by insertion of a cutting tool through the aligned opening of the housing in which the intermediate portions are disposed, thereby to provide electrically distinct contacts, each in electrical connection with a respective wire of the associated cable. Electrical connection is made to an associated device or circuit by plugging the housing over the pins of the device or circuit, to cause each pin to electrically engage a respective contact of the connector. The housing can include fastening elements for additional means of securing the connector to the associated device or circuit.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
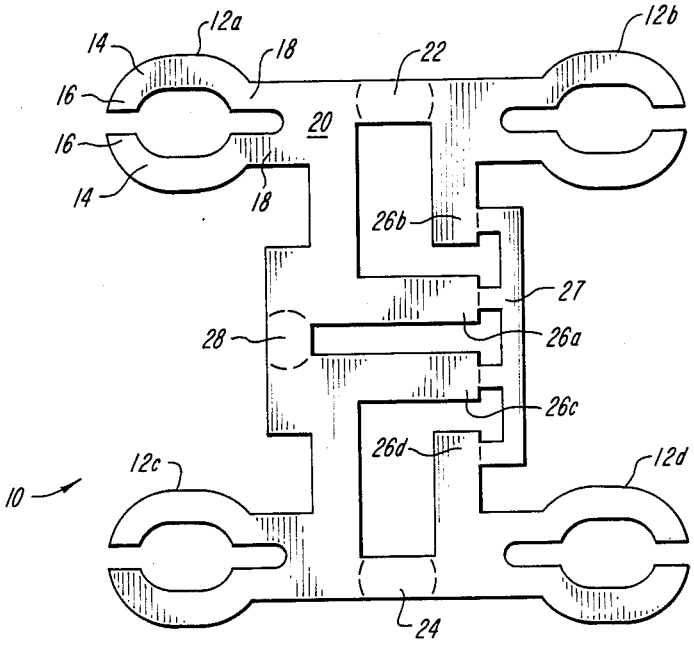
FIG. 1 is a plan view of a unitary frame in accordance with the invention.
Figure 2:
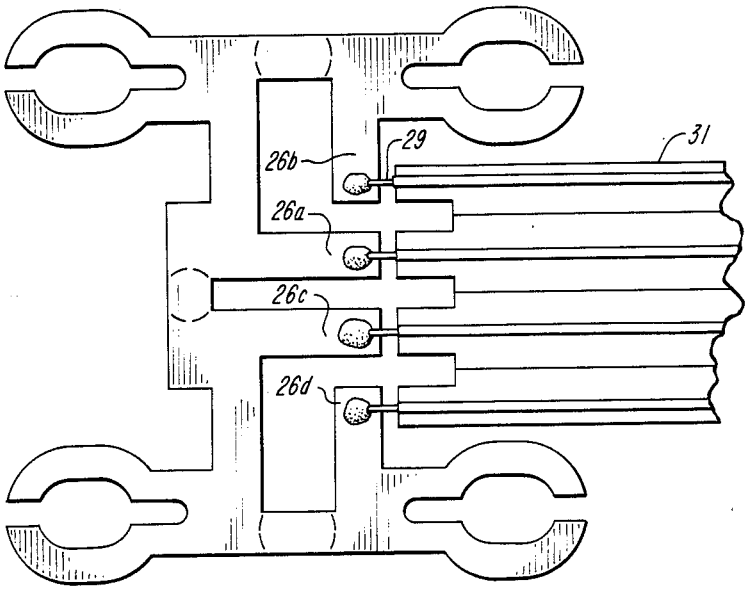
FIG. 2 is a plan view of the frame after connection to the wires of an associated electrical cable.

Referring to FIG. 1, there is shown a unitary planar frame 10 formed of a metal typically tin plated CA 260 brass, and which includes a plurality of contact members 12*a*–12*d* as integral constituents of the frame structure. In the illustrated embodiment, four contact members are shown; more or less contacts can be provided to suit the intended purposes. Each of the contact members includes generally semicircular sections 14 having distal ends 16 spaced from each other and inner ends 18 extending from a conductive tab 20. The conductive tabs 20 of the contact members 12*a* and 12*b* are interconnected by an intermediate portion 22. Similarly, the tabs 20 of the contact members 12*c* and 12*d* are interconnected by an intermediate portion 24. Each of the tabs includes an integral member which serves as a terminal to be connected to a respective wire of a multiwire cable. These terminal members are identified as 26*a*–26*d* in FIG. 1. A bridging portion 27 of the frame interconnects the terminal members as illustrated, and is severed from the frame prior to electrical connection of the cable wires to the terminals. The frame structure also includes an integral intermediate portion 28. The contact members are thus fabricated as part of a unitary metal frame assembly which is readily fabricated and handled during assembly of the connector. The frame is typically formed in repetitive manner from a continuous strip of metal by stamping dies and techniques which are per se known in the art. The frames are interconnected on a strip by any conveniently configured interconnecting portions of the strip which join adjacent frames of the strip. Each frame is severed from its interconnecting extensions to provide a single unitary frame structure for assembly into an associated housing after electrical connection to a cable. The wires 29 of a multiwire flat cable 31 are soldered or otherwise connected to respective terminal members 26a–26d as shown in FIG. 2.

Figure 3:
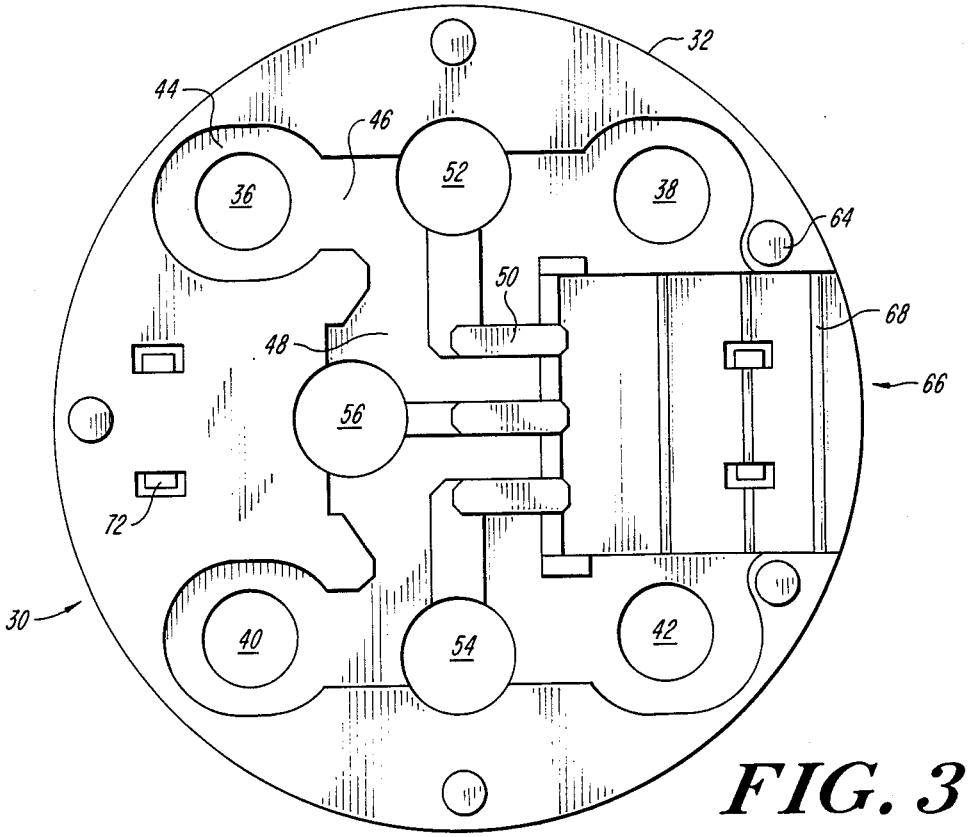
FIG. 3 is a plan view of the base section of the housing.

The housing 30 is preferably molded of a plastic electrically insulating material and is composed of a base section 32 and a cover section 34 which are operative to be mated together with the frame 10 therebetween for completion of the connector. The base section of the cover is depicted in FIG. 3, and is of disc configuration having a plurality of openings therethrough. The openings 36, 38, 40 and 42, include recessed portions 44 sized and configured to receive the respective contact members 12 of the frame structure. Recessed portions 46 and 48 are also provided for accommodation of the tab portions and intermediate portions of the frame. Outwardly extending flanges 50 are provided and serve to separate the respective terminal members 26 of the frame to which the cable is connected. Openings 52, 54 and 56 are configured to receive the intermediate portions 22, 24 and 28 of the frame, respectively.

Figure 4:
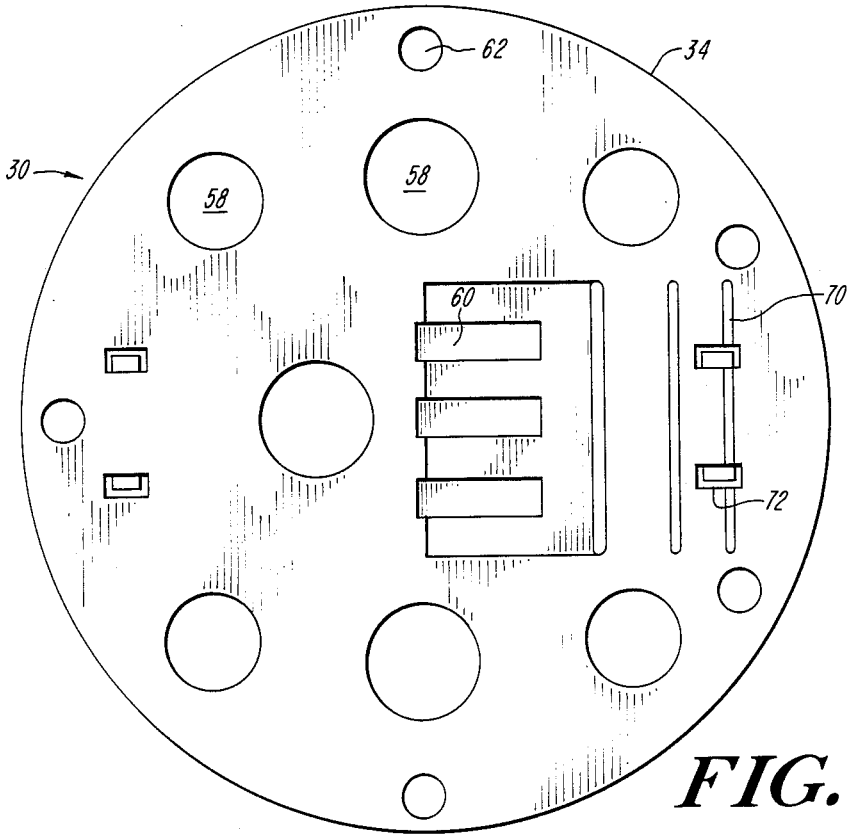
FIG. 4 is a plan view of the cover section of the housing.

The cover section 34 of the housing is shown in FIG. 4 and includes openings 58 which are aligned with the corresponding openings in the base section 32 when the housing sections are mated. The cover section also includes rectangular openings 60 which are cooperative with the outwardly extending flanges 50 of the base section and into which the distal ends of the flanges extend. The cover section also includes openings 62 which are cooperative with posts 64 provided on the base section, the posts serving to secure the housing sections together, such as by heat staking of the posts after their insertion through the cooperative openings in the cover when the housing sections are fitted together.

Figure 7:
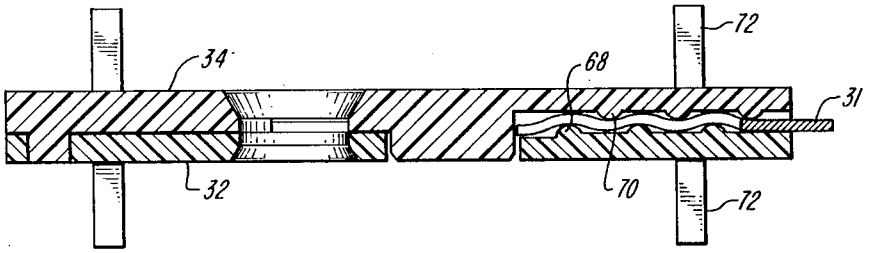
FIG. 7 is a sectional view taken along line 7—7 of FIG. 6.

The base section includes a lead-in area 66 for accommodation of the connected end of the cable. This lead-in area includes ridges 68 which are cooperative with longitudinally offset ridges 70 in the cover section to capture the wires of the cable and act as a stress relieving clamp, as shown in FIG. 7, to prevent undue force on the solder connections in the event that the cable or connector are subjected to pulling forces. The housing can also include on either or both sections thereof fasteners, such as the outwardly extending clips 72 illustrated, for additional support of the connector on an associated device or circuit.

Figure 5:
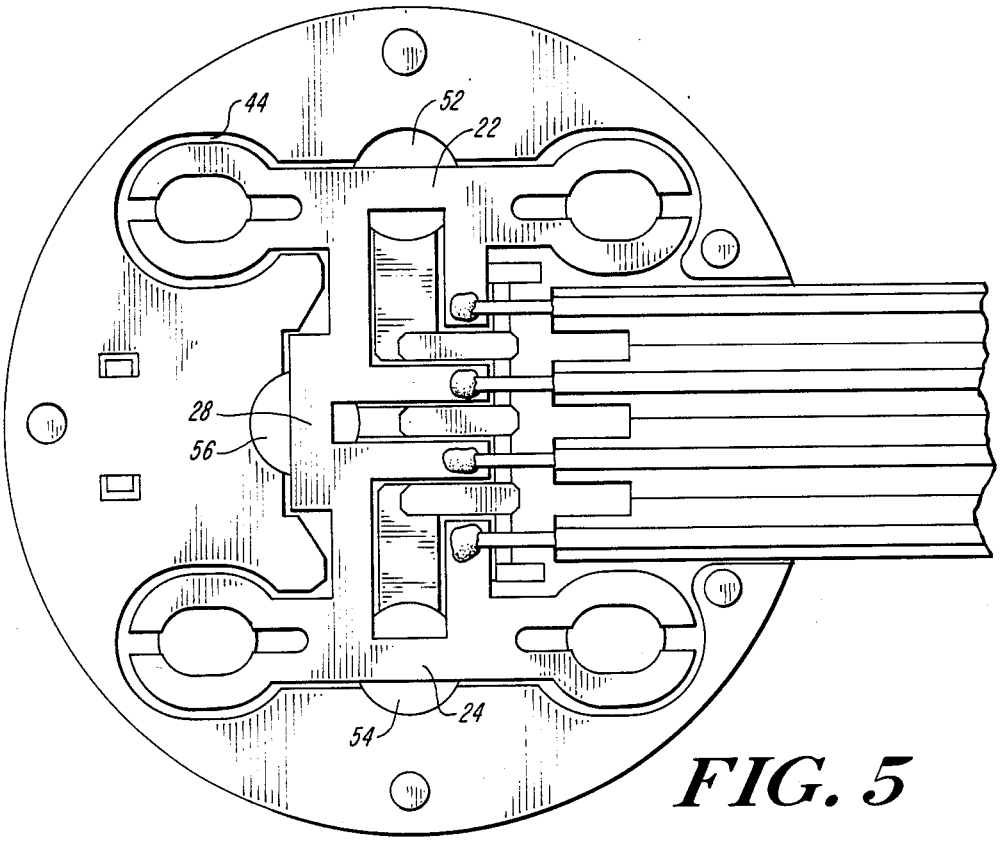
FIG. 5 is a plan view of the frame and connected cable installed on the base section of the housing.

The frame and interconnected wires are installed as a unit in the base section of the housing, as shown in FIG. 5. The constituents of the unitary frame lie within associated recesses in the base section for accurate positioning and retention of the frame elements. The contact members 12 are enclosed within the respective recesses of the base section, and the semicircular sections 14 are yieldable within the recess to provide spring engagement and electrical contact with a terminal pin when the pin is inserted through the contact member.

Figure 6:
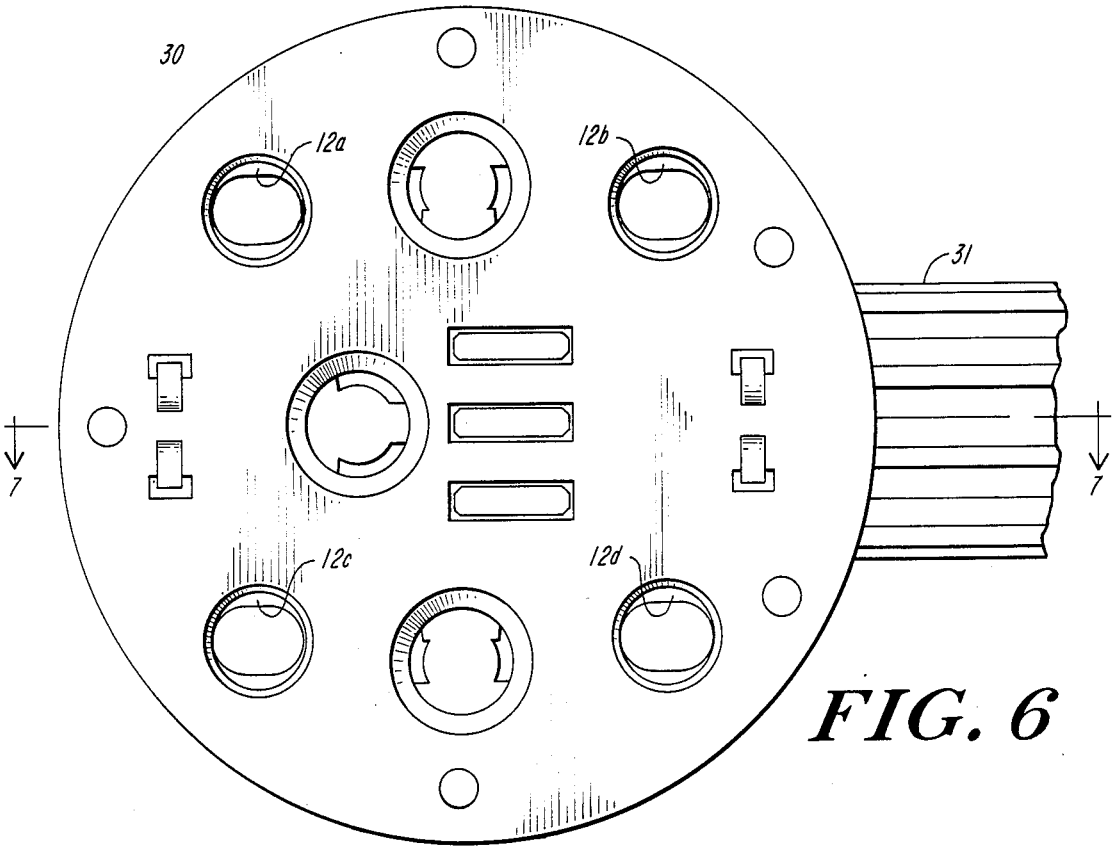
FIG. 6 is a plan view of the housing sections interconnected with the frame and connected wire cable therein.

The assembled connector is depicted in FIG. 6, and it is seen that each contact member 12 is disposed within corresponding aligned openings of the housing. The intermediate portions 22, 24 and 28 are also disposed within corresponding aligned openings (FIG. 5). These intermediate portions are severed from the frame (FIG. 6) by insertion of a cutting tool through the associated openings. After removal of the intermediate portions, the contacts are electrically separated from each other and are each electrically connected only to a respective wire of the cable.

The invention is not to be limited by what has been particularly shown and described except as indicated in the appended claims.

What is claimed is:

1. An electrical connector for interconnection between cable wires and terminal pins comprising:

a contact assembly including a planar frame of unitary structure having a plurality of contact members, a plurality of terminal members integral with respective ones of said plurality of contact members, intermediate portions integral with an maintaining the unitary structure between said plurality of contact members, and a bridging portion integral with and maintaining the unitary structure of said plurality of terminal members, and wherein said bridging portion is severable from said planar frame prior to physical and electrical connection of the cable to respective ones of said plurality of terminal members;

a housing including a base section having receptacle portions sized and configured for retaining said plurality of contact members yieldably movable therein and for retaining said plurality of terminal members of said planar frame, and a plurality of openings in alignment with respective ones of said plurality of contact members and said intermediate portions and wherein each of said plurality of contact members is yieldably movable in said corresponding receptacle portion to springally engage and electrically contact corresponding ones of the terminal pins pluggably coacting therewith, and a cover section having a first plurality of openings aligned with corresponding ones of said plurality of openings of said base section in alignment with respective ones of said plurality of contact members and said intermediate portions, and wherein said cover section is cooperative with said base section for retention of said planar frame within said housing formed by mating said base and cover sections;

ends of the cable wires being physically and electrically connected to said plurality of terminal members and disposed within said housing;

said intermediate portions being severable from said planar frame disposed within said housing by way of corresponding openings in said base section and cover section of said housing in alignment with said intermediate portions;

each of said plurality of contact members of said contact assembly having a spaced generally circular end operative to springally engage and electrically contact corresponding ones of the terminal pins;

said bridging portion being severable from said planar frame prior to physical and electrical connection of the cable wires to respective ones of said plurality of terminal members and wherein ends of the cable wires physically and electrically connected to said plurality of terminal members are disposed within said housing;

said base section and said cover section of said housing having a lead in area for retaining the cable wires and wherein said lead in area further includes at least one ridge extending from each of said base and said cover sections and wherein said at least one ridges extending from said base and cover sections are offset from one another along the axis of the cable wires and operative to capture the cable wires therebetween;

one of said base and cover sections having upstanding projections for positioning said contact members within said receptacle portions of said base section; and recesses in the other of said one of said base and cover sections, said recesses aligned and cooperative with said projections for maintaining the position of said contact members within said receptacle portions upon mating of said base and cover sections.

2. The connector of claim 1 wherein said base section and cover section are integrally formed.

3. The connection of claim 1 wherein said base section and cover section are generally circular.

4. The connector of claim 1 including means with integral said base and cover sections for fastening the base section to the cover section.

* * * * *

UNITED STATES PATENT AND TRADEMARK OFFICE

CERTIFICATE OF CORRECTION

PATENT NO. : 4,752,247

DATED : June 21, 1988

INVENTOR(S) : Jacque Warnars

It is certified that error appears in the above-identified patent and that said Letters Patent is hereby corrected as shown below:

On the Title Page,
[73] Assignee: "Altair, Inc., Mt. Clemens, Mich." should read --Altair International, Inc., Mt. Clemens, Mich.--.

Column 1, line 9, "into" should read --onto--.

Column 3, line 55, "recess" should read --recesses--.

Column 4, line 11, "with an" should read --with and--.

Signed and Sealed this

Eleventh Day of July, 1989

*Attest:*

*Attesting Officer*

DONALD J. QUIGG

*Commissioner of Patents and Trademarks*